US005279614A

United States Patent [19]

Uchida et al.

[11] Patent Number: 5,279,614

[45] Date of Patent: Jan. 18, 1994

[54] STAIN PREVENTIVE TREATMENT PROCESS FOR POLYAMIDE FIBER

[75] Inventors: Juji Uchida, Sabae; Katsuya Okumura; Masayuki Maeno, both of Fukui, all of Japan

[73] Assignee: Nicca Chemical Company Ltd., Fukui, Japan

[21] Appl. No.: 920,370

[22] PCT Filed: Dec. 12, 1990

[86] PCT No.: PCT/JP90/01626

§ 371 Date: Oct. 1, 1992

§ 102(e) Date: Oct. 1, 1992

[87] PCT Pub. No.: WO92/10604

PCT Pub. Date: Jun. 25, 1992

[51] Int. Cl.[5] ..... D06M 10/08

[52] U.S. Cl. ..... 8/115.51; 8/115.54; 8/115.65; 8/115.6; 252/86, 87

[58] Field of Search ..... 8/115.51, 115.54, 115.65, 8/115.6; 252/8.6, 8.7, 301.24, 301.26, 301.28, 301.32, 301.31

[56] References Cited

U.S. PATENT DOCUMENTS

| | | | |
|---|---|---|---|
| 4,340,388 | 7/1982 | Kowalski | 8/584 |
| 4,502,986 | 3/1985 | Robson | 252/174.16 |
| 4,745,142 | 3/1988 | Ohwaki et al. | 252/301.32 |
| 4,964,871 | 10/1990 | Reinert et al. | 8/115.51 |
| 5,009,667 | 4/1991 | Beck et al. | 8/115.51 |
| 5,015,259 | 5/1991 | Moss, III et al. | 8/115.51 |
| 5,030,245 | 7/1991 | Hemling et al. | 8/115.51 |
| 5,131,909 | 7/1992 | Hangey | 8/115.51 |
| 5,190,565 | 3/1993 | Berenbaum et al. | 8/115.51 |

FOREIGN PATENT DOCUMENTS

| | | |
|---|---|---|
| 4-91036 | 1/1974 | Japan . |
| 51-88922 | 8/1976 | Japan . |
| 61-47811 | 3/1986 | Japan . |
| 62-257467 | 11/1987 | Japan . |

*Primary Examiner*—Paul Lieberman
*Assistant Examiner*—William S. Parks
*Attorney, Agent, or Firm*—McAulay Fisher Nissen Goldberg & Kiel

[57] ABSTRACT

A staining preventive treatment process for polyamide fiber which comprises the application of the compound of general formula I below and the compound of general formula II below to the polyamide fiber:

I in which R independently represents or

X independently represents hydrogen or alkali metal, and l is a number from 3 to 20, provided that 50–70% of R is and the remainder is at least one group selected from —OX, (Abstract continued on next page.)

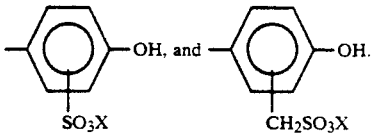
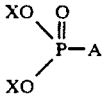
in which A represents
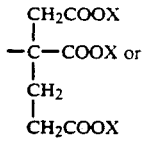
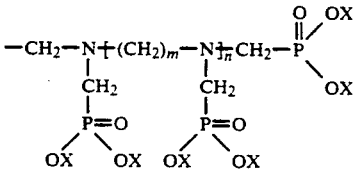
II
X independently represents hydrogen or alkali metal, m is an integer from 2 to 6, and n is 0, 1, or 2.
Staining by natural or artificial coloring agents is effectively prevented.
10 Claims, No Drawings

STAIN PREVENTIVE TREATMENT PROCESS FOR POLYAMIDE FIBER

TECHNICAL FIELD

The present invention relates to a treatment process for preventing staining of polyamide fiber, and more particularly to a treatment process to obtain a polyamide fiber material like nylon carpeting having stain-resistant properties.

BACKGROUND ART

Polyamide fiber material like nylon carpeting is susceptible to staining by natural and artificial coloring pigments contained in numerous food and beverages. Thus, when food and beverages are accidentally spilled onto polyamide fiber, the polyamide fiber ends up being stained by the coloring pigment contained in those food and beverages. These stains cannot easily be removed under ordinary laundering conditions. Several efforts have been made thus far to deal with this shortcoming of polyamide fiber. For example, polyamide fibers are treated with fluorine-based or silicone-based compounds. Examples of processes used commercially include adsorbing the formaldehyde condensate of a phenolic compound such as bisphenol S, a sulfonide of bisphenol S or phenolsulfonic acid onto the fiber either by immersion treatment or steaming following application by padding, spraying, or foam coating. There are also processes wherein fluorine-based compounds are applied using similar methods after the initial adsorbing process described above. Although staining by pigment contained in food and beverages can definitely be prevented, according to these processes, when these types of formaldehyde condensates of phenolic compounds are exposed to environments containing acidic gas such as nitrogen oxide gas, the formaldehyde condensates have the shortcoming of turning yellow on the fibers. In addition, when formaldehyde condensates of phenolic compounds are exposed to light, they also have the shortcoming of turning yellow on the fibers. Thus, no satisfactory method exists at present for protecting polyamide fiber from coloring pigment contained in food and beverages.

DISCLOSURE OF THE INVENTION

The present invention provides a treatment process that gives staining preventive effects to polyamide fiber materials like nylon carpeting with respect to stains caused by natural and artificial coloring pigments and enables products that demonstrate minimal discoloration when exposed to acidic gas such as nitrogen oxide gas and similarly demonstrate minimal yellowing when exposed to light.

According to the present invention, a staining preventive treatment process for polyamide fiber is provided which comprises the application of a compound indicated in general formula I below and a compound indicated in general formula II below to the polyamide fiber:

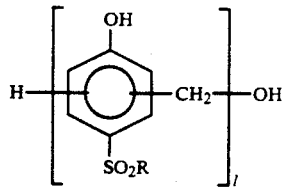

I

In the above formula, R independently represents —OX,

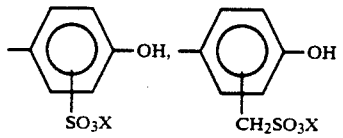

or

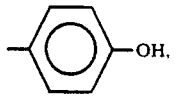

X independently represents hydrogen or alkali metal, and l is a number from 3 to 20, provided that 50–70% of R is

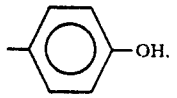

and the remainder is at least one group selected from —OX,

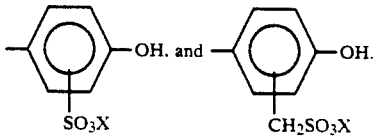

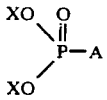

II

In the above formula, A represents

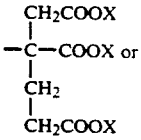

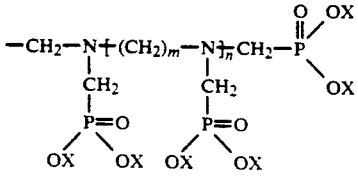

X independently represents hydrogen or an alkali metal, m is an integer from 2 to 6, and n is 0, 1, or 2.

BEST MODE FOR CARRYING OUT THE INVENTION

In the present invention, the application of the compound of formula I and the compound of formula II to the polyamide fiber may be performed in the same bath or may be performed in separate baths. In addition, when applying the compound of formula I and the compound of formula II in separate baths, either compound may be applied first.

In the compound of formula I, when 1 is smaller than 3, the resulting stain preventive effects are not adequate. When 1 is larger than 20, the product at the time of manufacturing this compound becomes gelled and lacks sufficient water solubility. As a result, its manufacture is difficult. Similarly, when— —OH as R is less than 50%, the resulting stain preventive effects are inadequate, and when that amount exceeds 70%, the problem occurs that the solubility of the product at the time of manufacture is insufficient.

Although the compound of formula I is typically obtained by a condensation reaction between a phenol compound and formaldehyde, the degree of condensation (1) and molecular weight of the product in that case are distributed over a prescribed range. Thus, it should be understood that 1 in formula I is expressed by a mean value.

In the compound of formula II, in the case the value of m is outside the range of 2 to 6, the light fastness of the resulting product may be inadequate.

In the present invention, polyamide fiber refers to a synthetic fiber comprised of amide bonds and is typically represented by Nylon 6 and Nylon 66. This polyamide fiber may be in the form of a woven or knitted fabric and carpeting, car mats, or car seats comprised of its raised products.

Polyamide fiber is used widely, especially in carpeting, car mats, and car seats, due to its superior fiber properties. Polyamide fiber also has the additional characteristic of being able to be dyed to vivid colors in the case of dyeing with an acid dye. This is also a reason for its use in the above-mentioned applications.

On the other hand, numerous food and beverages contain natural or artificially synthesized coloring agents such as the Japanese food additive Red Dye No. 40. When these coloring agents are accidentally spilled on polyamide fiber, the coloring agent ends up coloring the polyamide fiber. The resulting stain cannot be completely removed under ordinary laundering conditions. The present invention provides a process that extremely effectively prevents the staining of polyamide fiber by coloring pigments contained in food and beverages by applying a processing agent to the polyamide fiber in advance for the purpose of preventing staining so that the stains can be easily removed by simple laundering.

According to the present invention, it has been found that by applying two types of compounds having different chemical structures to polyamide fiber, polyamide fiber can be obtained having the desired stain preventive effects due to the synergistic effects of the above-mentioned compounds, while also demonstrating an extremely low degree of yellowing when exposed to nitrogen oxide gas or sunlight. Although the details regarding the mechanism by which these effects are obtained are unknown, this is believed to be the result of the compound of formula II having a unique molecular structure containing numerous phosphonic acid groups or carboxyl groups in its molecule. In other words, the presence of the compound of general formula II prevents the stain preventive effects of the compound of general formula I with respect to coloring pigment from being inhibited. As a result, the use of the compound of general formula I required to maintain the prescribed stain preventive effects is reduced, thereby preventing the yellowing of the compound of general formula I caused by acidic gas and light.

If only one of either the compound of general formula I, a stain preventive agent for natural and artificial coloring agents, and the compound of general formula II is used, the object of the present invention cannot be accomplished. Therefore, the compounds are dissolved in water after either mixing or placing in separate treatment baths in advance and either coated or adsorbed onto polyamide fiber by a method such as immersion, padding, spraying, or foam coating. In addition, as was previously stated, the compounds may be respectively applied from different baths.

The compound of general formula I may be of the resol type or novolak type and can be easily manufactured by, for example, condensing a phenolic compound such as bisphenol S or phenol with an aldehyde such as formaldehyde after partially sulfonating in advance. The compounds can be selected from products commercially available as dyeing fastness promoters for nylon fiber used to effectively suppress staining caused by natural or artificial coloring agents in particular. In addition, such compounds are described in U.S. Pat. No. 4,592,940, Japanese Unexamined Patent Publication No. 62-257467, and Japanese Unexamined Patent Publication No. 62-199877. In addition, commercially available products can be used for the compound of general formula II, and a portion or all of their carboxyl groups or phosphonic acid groups may be substituted by alkali metals such as sodium or potassium.

It is desirable that the compound of general formula I be applied in the polyamide fiber over a range of 0.05–5%, and preferably 0.1–2%, with respect to the weight of the fiber. In addition, it is desirable that the compound of general formula II be applied in the polyamide fiber over a range of 0.1–10%, and preferably 1–5%, with respect to the weight of the fiber.

It is effective to combine the use of a pH regulator, such as acetic acid, formic acid, or sulfamic acid and an inorganic compound such as magnesium sulfate, magnesium chloride, or calcium chloride, which promotes adsorption by the compound of general formula I and the compound of general formula II, with the compound of general formula I and the compound of general formula II in the treatment bath.

Polyamide fiber materials are treated in the above-mentioned treatment bath either after scouring or after dyeing using a method such as immersion, padding, spraying, or foam coating and are fixed by steaming. Although the material should then be typically post-treated by treatment in a manner similar to the above-mentioned process using a fluorine-based water repellent followed by drying and heat setting, the present invention is still able to demonstrate remarkable effects related to stain prevention against coloring pigment even without this post-treatment.

The present invention will further be illustrated by the following examples.

SYNTHESIS EXAMPLE 1

170 g of 99.9% purity bisphenol S (Nikka Chemical). 150 g of sodium phenolsulfonate (first class grade chemical), 27 g of 48% industrial sodium hydroxide, and 270 g of water were placed in a glass autoclave for reaction followed by nitrogen purging. Next, the temperature was raised to 80° C. and the autoclave was sealed after addition of 65 g of 37% industrial formalin. The temperature was raised to 130° C. in about 60 minutes and condensation was performed at this temperature for 5 hours. After cooling, 370 g of water were added followed by uniform mixing to form the finished product.

SYNTHESIS EXAMPLE 2

230 g of 99.9% purity bisphenol S (Nikka Chemical), 35 g of 48% industrial sodium hydroxide, and 200 g of water were placed in a glass four-neck flask for reaction followed by nitrogen purging. Next, the temperature was raised to 80° C. followed by the addition of 70 g of 37% industrial formalin. The temperature was then raised to 100° C. in about 20 minutes in the presence of nitrogen gas after which condensation was performed at this temperature for 4 hours. After cooling to 70° C., 140 g of sodium hydroxymethanesulfonate were added followed by mixing to create a uniform mixture. After adding 45 g of 48% sodium hydroxide, the temperature was raised to 100° C. in 30 minutes at which temperature the mixture was allowed to react for 20 minutes. The temperature was then raised to 70°-80° C. followed by the addition of 250 g of water and uniform mixing to obtain the finished product.

SYNTHESIS EXAMPLE 3

240 g of 99.9% purity bisphenol S (Nikka Chemical) were placed in a glass four-neck flask for reaction. Next, 100 g of 97% industrial sulfuric acid were added followed by sulfation for 10 hours at 110° C. After raising the temperature to 80° C., 100 g of water and 90 g of 37% formalin were added followed by condensation for 5 hours at 100° C. Following completion of the reaction, 270 g of water were added followed by uniform mixing to obtain the finished product.

PERFORMANCE TESTING

1. Test Cloth Samples

The following were used for the test cloth samples.

(a) Nylon 6 scoured knitted cloth (fabric weight 0.13 kg/m$^2$)

(b) Nylon 6 carpet cloth washed with hot water (fabric weight: 1.20 kg/m$^2$)

(c) Nylon 66 carpet cloth washed with hot water (fabric weight: 0.97 kg/m$^2$)

2. Treatment Process (1) Polyamide Fiber Stain Preventive Treatment (Padding Method)

The stain preventing agent obtained in the above-mentioned syntheses along with magnesium sulfate were dissolved in water. The nylon test cloth was then immersed in this solution. The cloth was then padded at a pick-up of 80% using a mangle. The cloth was then steamed for 15 minutes at 100° C. with a high temperature steamer made by Tsujii Dyeing Machines without drying. Next, water was also padded in the same manner at a pick-up of 80% to remove any unfixed stain preventive agent. Finally, the cloth was submitted for performance testing after drying for 8 minutes at 120° C. in a dryer.

(2) Polyamide Fiber Stain Preventive Treatment (Immersion Method)

The prescribed amount of stain preventive agent obtained in the above-mentioned syntheses along with magnesium sulfate were dissolved in water in a dyeing vat followed by the addition of sulfamic acid or sodium hydroxide to adjust to pH 2. Nylon test cloth was then placed in the dyeing vat followed by treatment for 20 minutes at 70° C. using a Mini-Color dyeing machine made by Texam Giken. The cloth was then washed with water for 10 minutes at room temperature and submitted for performance testing after drying for 8 minutes at 120° C.

3. Evaluation Method (1) Stain Prevention Performance Test

After uniformly cutting the above-mentioned test cloths into 5 cm×5 cm squares, each of the test cloths were immersed for 1 hour at room temperature in 100 ml of an aqueous solution containing 0.054 g/l of Japanese food additive Red Dye No. 40, and 0.2% citric acid. Following immersion, the test cloths were washed for 10 minutes using a full tub of water in a domestic washing machine followed by drying. The surface dye concentration (K/S) was measured with a Macbeth Color Eye colorimeter to evaluate the degree of staining of polyamide fiber by Red Dye No. 40. Those results are indicated in the following table taking the K/S of each of the samples to be the relative value when the K/S of each of the polyamide fibers not treated with stain preventive agent is taken to be 100. A smaller relative value indicates superior stain preventing effects.

(2) Nitrogen Oxide Gas Discoloration Test

Following treatment of each of the samples according to the method of JIS-0085, the whiteness (Hunter white index) of each of the samples was measured using a Macbeth Color Eye colorimeter for samples following three units of testing. The measured values are indicated in the table below. A larger value indicates favorable whiteness and the absence of discoloration.

(3) Light Fastness Test

The test cloths were treated for 20 hours at 63° C. using a high-temperature Fade-O-meter (Suga Test Machines). The whiteness (Hunter white index) of each of the test cloths was measured following testing using a Macbeth Color Eye colorimeter. The resulting measured values are indicated in the table below. A larger value indicates favorable whiteness and the absence of discoloration.

4. Results

The results are summarized in Tables 1-3.

Table 1 indicates the results in the case of performing stain preventive treatment by padding on the test cloth sample a. Table 2 indicates the results in the case of performing stain preventive treatment by immersion on the test cloth sample b. Table 3 indicates the results in the case of performing stain preventive treatment by padding on the test cloth sample c.

TABLE 1

| Stain preventive agent | Amt. used in padding bath | Staining degree Meas. K/S value | Staining degree (Relative value) | Degree of discoloration (whiteness) by nitrogen oxide gas and light: Stain preventive treated cloth | After NOx test | After light fastness test |
|---|---|---|---|---|---|---|
| 1:2 mixture of synthesis ex. 1 compound and 2-phosphonobutane tricarboxylic acid-1,2,4 | 2% | 0.05 | (3.2) | 69.59 | 63.32 | 63.71 |
| 1:1 mixture of synthesis ex. 1 compound and 2-phosphonobutane tricarboxylic acid-1.2.4 | 1% | 0.09 | (5.7) | 70.73 | 64.45 | 64.08 |
| 1:2 mixture of synthesis ex. 2 compound and 2-phosphonobutane tricarboxylic acid-1,2,4 | 5% | 0.04 | (2.5) | 69.55 | 65.11 | 64.67 |
| 1:2 mixture of synthesis ex. 3 compound and 2-phosphonobutane tricarboxylic acid-1,2.4 | 2% | 0.06 | (3.8) | 68.58 | 62.73 | 64.76 |
| 1:2 mixture of synthesis ex. 3 compound and aminotri(methylene-phosphonic acid) | 2% | 0.06 | (3.8) | 70.56 | 63.45 | 62.08 |
| 1:2 mixture of synthesis ex. 3 compound and diethylenetriamine penta(methylene-phosphonic acid) | 2% | 0.07 | (4.5) | 71.58 | 65.50 | 64.59 |
| 1:2 mixture of synthesis ex. 3 compound and ethylenediamine tetra(methylene-phosphonic acid) | 2% | 0.08 | (5.1) | 69.65 | 63.20 | 62.64 |
| 1:2 mixture of synthesis ex. 3 compound and hexamethylene-diamine tetra(methylene-phosphonic acid) | 2% | 0.10 | (6.4) | 68.86 | 62.88 | 62.67 |
| Synthesis ex. 1 compound (comparative example) | 2% | 0.06 | (3.8) | 68.43 | 54.20 | 53.55 |
| Synthesis ex. 1 compound (comparative example) | 0.5% | 0.11 | (7.0) | 69.55 | 55.14 | 56.42 |
| Synthesis ex. 2 compound (comparative example) | 2% | 0.07 | (4.5) | 69.50 | 53.04 | 54.40 |
| Synthesis ex. 3 compound (comparative example) | 2% | 0.09 | (5.7) | 66.65 | 52.42 | 53.18 |
| Stain preventive treatment not performed (original cloth) | — | 1.57 | (100.0) | 71.73 | 69.94 | 71.61 |

TABLE 2

| Stain preventive agent | Amt. used in immersion bath | Staining degree Meas. K/S value | Staining degree (Relative value) | Degree of discoloration (whiteness) by nitrogen oxide gas and light: Stain preventive treated cloth | After NOx test | After light fastness test |
|---|---|---|---|---|---|---|
| 1:2 mixture of synthesis ex. 1 compound and 2-phosphonobutane tricarboxylic acid-1,2.4 | 2% | 0.22 | (17.6) | 56.73 | 54.18 | 53.39 |
| 1:1 mixture of synthesis ex. 1 compound and 2-phosphonobutane tricarboxylic acid-1,2,4 | 1% | 0.24 | (19.2) | 57.08 | 55.01 | 53.23 |
| 1:2 mixture of synthesis ex. 2 compound and 2-phosphonobutane tricarboxylic acid-1.2.4 | 5% | 0.21 | (16.8) | 57.16 | 55.41 | 54.40 |
| 1:2 mixture of synthesis ex. 3 compound and 2- | 2% | 0.23 | (18.4) | 56.37 | 53.33 | 51.85 |

TABLE 2-continued

| Stain preventive agent | Amt. used in immersion bath | Staining degree Meas. K/S value | Staining degree (Relative value) | Degree of discoloration (whiteness) by nitrogen oxide gas and light: Stain preventive treated cloth | After NOx test | After light fastness test |
|---|---|---|---|---|---|---|
| phosphonobutane tricarboxylic acid-1,2,4 | | | | | | |
| 1:2 mixture of synthesis ex. 3 compound and aminotri(methylene-phosphonic acid) | 2% | 0.22 | (17.6) | 56.96 | 53.65 | 52.18 |
| 1:2 mixture of synthesis ex. 3 compound and diethylenetriamine penta(methylene-phosphonic acid) | 2% | 0.24 | (19.2) | 57.03 | 53.60 | 52.92 |
| 1:2 mixture of synthesis ex. 3 compound and ethylenediamine tetra(methylene-phosphonic acid) | 2% | 0.23 | (18.4) | 56.88 | 53.62 | 52.20 |
| 1:2 mixture of synthesis ex. 3 compound and hexamethylenediamine tetra(methylene-phosphonic acid) | 2% | 0.24 | (19.2) | 56.76 | 53.51 | 51.67 |
| Synthesis ex. 1 compound (comparative example) | 2% | 0.29 | (23.2) | 55.09 | 44.90 | 41.25 |
| Synthesis ex. 1 compound (comparative example) | 0.5% | 0.27 | (21.6) | 56.18 | 44.97 | 43.40 |
| Synthesis ex. 2 compound (comparative example) | 2% | 0.30 | (24.0) | 56.94 | 50.09 | 44.18 |
| Synthesis ex. 3 compound (comparative example) | 2% | 0.28 | (22.4) | 54.47 | 43.33 | 43.42 |
| Stain preventive treatment not Performed (original cloth) | — | 1.25 | (100.0) | 57.82 | 56.17 | 53.82 |

TABLE 3

| Stain preventive agent | Amt. used in padding bath | Staining degree Meas. K/S value | Staining degree (Relative value) | Degree of discoloration (whiteness) by nitrogen oxide gas and light: Stain preventive treated cloth | After NOx test | After light fastness test |
|---|---|---|---|---|---|---|
| 1:2 mixture of synthesis ex. 1 compound and 2-phosphonobutane tricarboxylic acid-1,2,4 | 2% | 0.14 | (25.5) | 59.98 | 55.18 | 54.39 |
| 1:1 mixture of synthesis ex. 1 compound and 2-phosphonobutane tricarboxylic acid-1,2,4 | 1% | 0.16 | (29.1) | 60.06 | 56.01 | 54.23 |
| 1:2 mixture of synthesis ex. 2 compound and 2-phosphonobutane tricarboxylic acid-1.2.4 | 5% | 0.12 | (21.8) | 59.31 | 55.41 | 54.40 |
| 1:2 mixture of synthesis ex. 3 compound and 2-phosphonobutane tricarboxylic acid-1,2,4 | 2% | 0.13 | (23.6) | 60.10 | 56.06 | 57.45 |
| 1:2 mixture of synthesis ex. 3 compound and tminotri(methylene-phosphonic acid) | 2% | 0.12 | (21.8) | 60.18 | 57.31 | 57.71 |
| 1:2 mixture of synthesis ex. 3 compound and diethylenetriamine penta(methylene-phosphonic acid) | 2% | 0.15 | (27.3) | 60.23 | 57.94 | 57.58 |
| 1:2 mixture of synthesis ex. 3 compound and ethylenediamine | 2% | 0.16 | (29.1) | 60.15 | 56.10 | 54.15 |

TABLE 3-continued

| Stain preventive agent | Amt. used in padding bath | Staining degree Meas. K/S value | Staining degree (Relative value) | Degree of discoloration (whiteness) by nitrogen oxide gas and light: Stain preventive treated cloth | After NOx test | After light fastness test |
|---|---|---|---|---|---|---|
| tetra(methylene-phosphonic acid) | | | | | | |
| 1:2 mixture of synthesis ex. 3 compound and hexamethylenediamine tetra(methylene-phosphonic acid) | 2% | 0.17 | (30.9) | 59.26 | 54.39 | 53.22 |
| Synthesis ex. 1 compound (comparative example) | 2% | 0.16 | (29.1) | 58.31 | 5o.57 | 50.01 |
| Synthesis ex. 1 compound (comparative example) | 0.5% | 0.22 | (40.0) | 59.98 | 51.72 | 50.44 |
| Synthesis ex. 2 compound (comparative example) | 2% | 0.16 | (29.1) | 58.84 | 52.28 | 51.17 |
| Synthesis ex. 3 compound (comparative example) | 2% | 0.14 | (25.5) | 58.42 | 51.89 | 50.68 |
| Stain preventive treatment not performed (original cloth) | — | 0.55 | (100.0) | 60.65 | 58.82 | 57.88 |

Looking at the stain preventive effects by the stain preventive agent in terms of the relative values in the above-mentioned results, as the relative values are greater in the case of Nylon 66 in comparison to Nylon 6, it appears that the effects of the stain preventive agent are demonstrated with greater difficulty. This is because the degree of staining by a pigment of Nylon 66 is less than that of Nylon 6 even in the absence of treatment. Thus, in comparing Nylon 6 carpeting and Nylon 66 carpeting on which stain preventive treatment is performed using the same stain preventive agent, Nylon 66 demonstrates a smaller K/S value, indicating a lesser degree of staining by pigment.

Polyamide fiber on which stain preventive treatment is performed according to the present invention demonstrated superior stain preventive effects with respect to staining by pigment in all cases. Moreover, the degree of discoloration caused by nitrogen oxide gas and light was extremely low.

Industrial Applicability

The present invention can be effectively used to manufacture polyamide fiber materials having superior stain preventive effects while demonstrating a low level of discoloration by acidic gas and light.

We claim:

1. A staining preventive treatment process for polyamide fiber which comprises the application of a compound of general formula I below and a compound of general formula II below to the polyamide fiber,

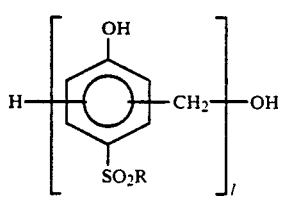

I in which R independently represents —OX

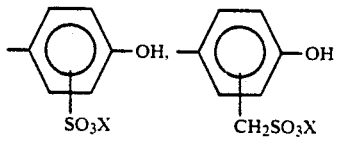

or

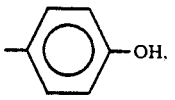

X independently represents hydrogen or alkali metal, and l is a number from 3 to 20, provided that 50–70% of R is

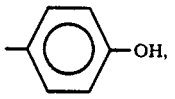

and the remainder is at least one group selected from —OX,

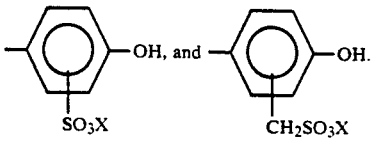

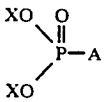

II in which A represents

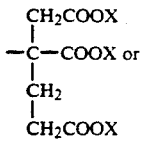

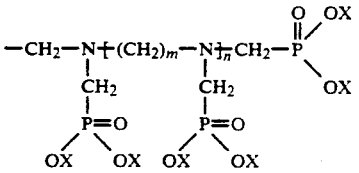

X independently represents hydrogen or alkali metal, m is an integer from 2 to 6, and n is 0, 1, or 2.

2. A process according to claim 1, wherein the compound of formula I and the compound of formula II are applied in the same bath.

3. A process according to claim 1, wherein application of the compound of formula I and application of the compound of formula II are performed in separate baths.

4. A process according to claim 1, wherein the compound of formula I and the compound of formula II are applied in the form of an aqueous solution.

5. A process according to claim 4, wherein application is performed by immersion, padding, spraying, or foam coating.

6. A process according to claim 1, wherein the amount of the compound of formula I applied is 0.05–5.0% based on the weight of the fiber.

7. A process according to claim 1, wherein the amount of the compound of formula II applied is 0.1–10% based on the amount of fiber.

8. A process according to claim 1, wherein the polyamide fiber is either Nylon 6 or Nylon 66 fiber.

9. A process according to claim 1, wherein the polyamide fiber is in the form of a woven or knitted fabric or its raised product.

10. A polyamide fiber treated by the process set forth in claim 1.

* * * * *